US005916338A

United States Patent [19]

Bergkvist et al.

[11] Patent Number: 5,916,338

[45] Date of Patent: Jun. 29, 1999

[54] HAMMER WITH RECOIL DAMPENING MECHANISM AND COUNTERWEIGHT

[75] Inventors: Håkan Bergkvist, Bromma; Olle Bobjer, Spånga; Bo Lindovist, Älta, all of Sweden

[73] Assignee: Hultafors AB, Hultafors, Sweden

[21] Appl. No.: 08/983,639

[22] PCT Filed: Jul. 11, 1996

[86] PCT No.: PCT/SE96/00945

§ 371 Date: Jan. 28, 1998

§ 102(e) Date: Jan. 28, 1998

[87] PCT Pub. No.: WO97/04925

PCT Pub. Date: Feb. 13, 1997

[30] Foreign Application Priority Data

Jul. 28, 1995 [SE] Sweden ..... 9502717

[51] Int. Cl.[6] ..... B25D 1/00

[52] U.S. Cl. ..... 81/22; 81/20

[58] Field of Search ..... 81/22, 20

[56] References Cited

U.S. PATENT DOCUMENTS

| | | | |
|---|---|---|---|
| 1,304,647 | 5/1919 | Basta | 81/20 |
| 2,604,914 | 7/1952 | Kahlen | 81/22 |
| 4,039,012 | 8/1977 | Cook . | |
| 4,674,746 | 6/1987 | Benoit . | |
| 4,697,481 | 10/1987 | Maeda | 81/22 |
| 4,882,955 | 11/1989 | Savnik | 81/20 |
| 5,058,902 | 10/1991 | McCutchen | 473/537 |
| 5,362,046 | 11/1994 | Sims | 473/300 |
| 5,375,486 | 12/1994 | Carmien | 81/22 |
| 5,375,487 | 12/1994 | Zimmerman | 81/22 |
| 5,537,896 | 7/1996 | Halder | 81/22 |
| 5,588,343 | 12/1996 | Rust et al. | 81/22 |
| 5,704,259 | 1/1998 | Riehle | 81/22 |

OTHER PUBLICATIONS

"'No bounce' Hammer Has Plastic Tips", Popular Mechanics Magazine (Jan. 1950) p. 165.

*Primary Examiner*—David A. Scherbel
*Assistant Examiner*—Joni B. Danganan
*Attorney, Agent, or Firm*—Birch, Stewart, Kolasch & Birch, LLP

[57] ABSTRACT

A hammer, preferably a workshop hammer including a head and an adjoining handle. The head is provided with at least one impact surface and a cavity which is at least partly filled with particulate material so as to dampen the recoil of the hammer. The hammer reduces recoil, rotation, and vibration of the hammer whereby an ergonomic hammer is obtained. The hammer is provided with a rigid longitudinally extending element in the handle and a counterweight at a free end thereof.

8 Claims, 5 Drawing Sheets

HAMMER WITH RECOIL DAMPENING MECHANISM AND COUNTERWEIGHT

This application is the national phase under 35 U.S.C. §371 of prior PCT International Application No. PCT/SE96/00945 which has an International filing date of Jul. 11, 1996 which designated the United States of America, the entire contents of which are hereby incorporated by reference.

TECHNICAL FIELD

The present invention relates to a hammer, comprising a head and an adjoining handle having a grip portion, the head of the hammer being provided with at least one impact surface and a cavity, which is at least partly filled with a particulate material so as to dampen the recoil. The hammer according to the present invention is primarily intended to be used as a workshop hammer.

PRIOR ART

Traditionally, man has learned how to design a hammer in order to fit the intended purpose. The dimensions of the hammer were related to measures of the human body. The length of the hammer was often equal to three times the width of a hand and the weight of the hammer head was equal to the weight of the hand. The advantage with such a design philosophy was that the hammer, which was often manufactured by the user, was also dimensioned to fit the owner or user. Different groups of craftsmen developed their own traditions in this field. Thus, blacksmith hammers and stonemason hammers are different in shape and have been refined through the years. Upon mass production of tools, much of the old skill from many generations disappeared. The individual adjustment became poor. Generally, the aim was to design tools which would fit to many people. Since there is a great difference in bodily measures and strength between men and women, there is an attempt in modern ergonomics to overcome these differences. Today, the object of the designer is to create tools which can be used by as many people as possible without being less efficient or hurting anybody.

U.S. Pat. No. 4,039,012 describes a hammer, the head of which is filled with lead shot in order to absorb a part of the impact wave energy being generated in the hammer head in connection with a stroke. The energy absorption in the head will dampen the recoil, as will be discussed further below.

U.S. Pat. No. 1,304,647 describes a hammer, the handle of which is provided with a counterweight at its free end. The purpose of this counterweight is to statically balance the hammer and thereby reduce the moment of force appearing in the wrist when the user holds the handle of the hammer.

SUMMARY

The object of the present invention is to provide a hammer satisfying, to the largest possible extent, the ergonomical and technological requirements of the user, i.e. that the recoil movement, including the rebound rotation, is controlled so as to correspond to the natural movement of the user's hand and that the vibrations in the handle are reduced. This object is achieved for a hammer having the features stated in the appended patent claims.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Some embodiments of the hammer according to the present invention will now be described with reference to the drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
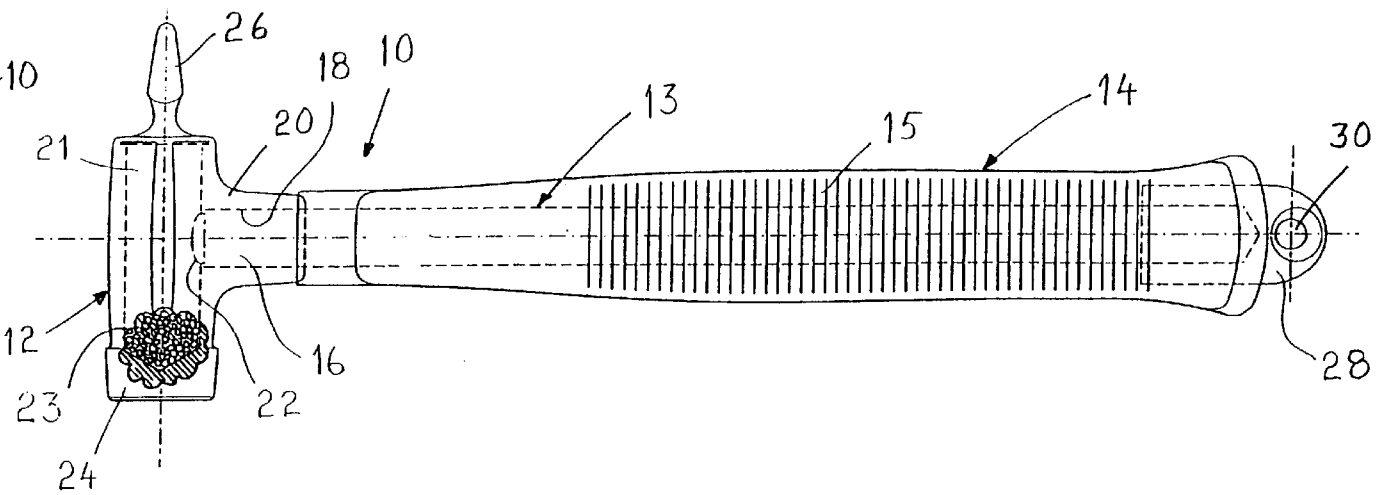
FIG. 1 is a side view of an embodiment of a hammer according to the present invention.
Figure 2:
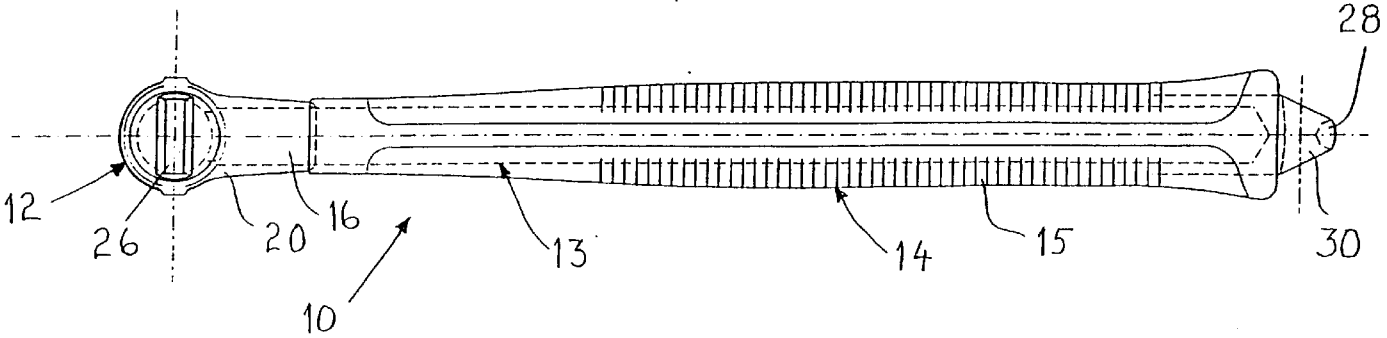
FIG. 2 is a top view of the hammer according to FIG. 1.
Figure 3:
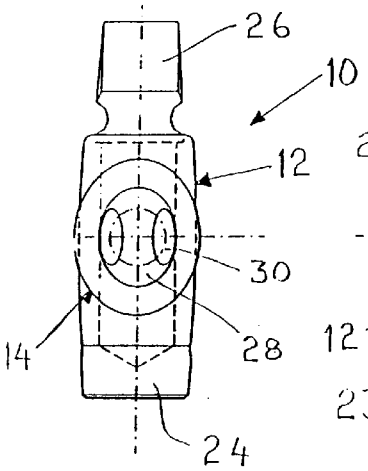
FIG. 3 is a rear view of the hammer according to FIG. 1.

The hammer 10 shown in FIGS. 1–3 includes a head 12, preferably of a metallic material, and a handle 14 being securely connected to the head 12, the handle including an internal, rigid tube 13, one end 16 of which forms the connecting end of the handle 14 and is received, preferably with a press fit, in a through hole 18 in a projecting portion 20 of the head 12. However, other types of connection are also possible within the scope of the invention.

The head 12 is provided with a cavity 21 which is filled, at least partly and preferably substantially completely, with a material 23 in the form of particles, preferably steel pellets having a diameter of 1–2 mm. The material 23 is preferably inserted into the cavity 21 via the through hole 18 before the handle 14 and the head 12 are connected to each other. The cavity 21 is filled with particulate material to at least 90%. At the free end of the connection end 16 of the handle 14 there is a plug 22 which prevents the particulate material from entering the tube 13 of the handle 14.

The head 12 is provided with an impact element 24 at its lower end in FIG. 1 and a peen 26 at its upper end in FIG. 1. The impact element is preferably forged in one piece with the head 12, although it is also possible within the scope of the invention that the impact element forms a separate part which is connected in a suitable manner to the head. The peen 26 is connected to the head 12 in a suitable manner, for example by soldering, (laser) welding, by a press fit or by threading. The reason for making the peen 26 as a separate part is to enable replacement thereof by a ball or a (plastic) impact element, see FIG. 7.

At the far end from the head 12, the handle 14 is provided with a counterweight 28 which is fitted to the internal tube 13 of the handle 14, e.g. with a press fit or by threads. The counterweight 28 is provided with a through opening 30 to enable hanging of the hammer 10 on a tool board or the like.

As appears from FIGS. 1 and 2, the handle is covered by an outer encasement 15 of a damping, elastic material, which provides good adhesion of the handle 14 in the hand of the user. The cross-sectional shape of the outer contour of the encasement 15 is oval in order to provide an optimal guidance of the stroke. Moreover, the outer encasement 15 is non-metallic in order not to cause nickel or chrome allergy. In the region of its ends, the outer encasement 15 joins to the projecting part 20 of the head 12 and to the outside of the counterweight 28, respectively. These joining portions of the outer encasement 15 have an oval shape so as to prevent the outer encasement 15 from being turned in relation to the internal tube 13.

The outer encasement 15 of the handle 14 of the hammer 10 is designed so as to permit different grips, i.e. a power grip in the region of the free end of the handle 14 as well as a precision grip closer to the hammer head 12. In order to achieve this, the outer encasement 15 is cambered approximately at the middle of its longitudinal extension.

Comparative studies will now be discussed, with reference to schematic computer simulated drawings, with regard to recoil, rebound rotation and vibration. A stroke against an anvil is regarded as the most difficult case of design. The hammer stroke itself has normally a duration of about 40 $\mu$s. After such a duration, the hammer head of a non-dampened hammer will obtain a recoil velocity being equal to the striking velocity. The recoil translatory movement of the hammer mass is generated by a force exerted between the hammer and the anvil during the stroke. The force has a magnitude of about 100,000 N.

Figure 5A:
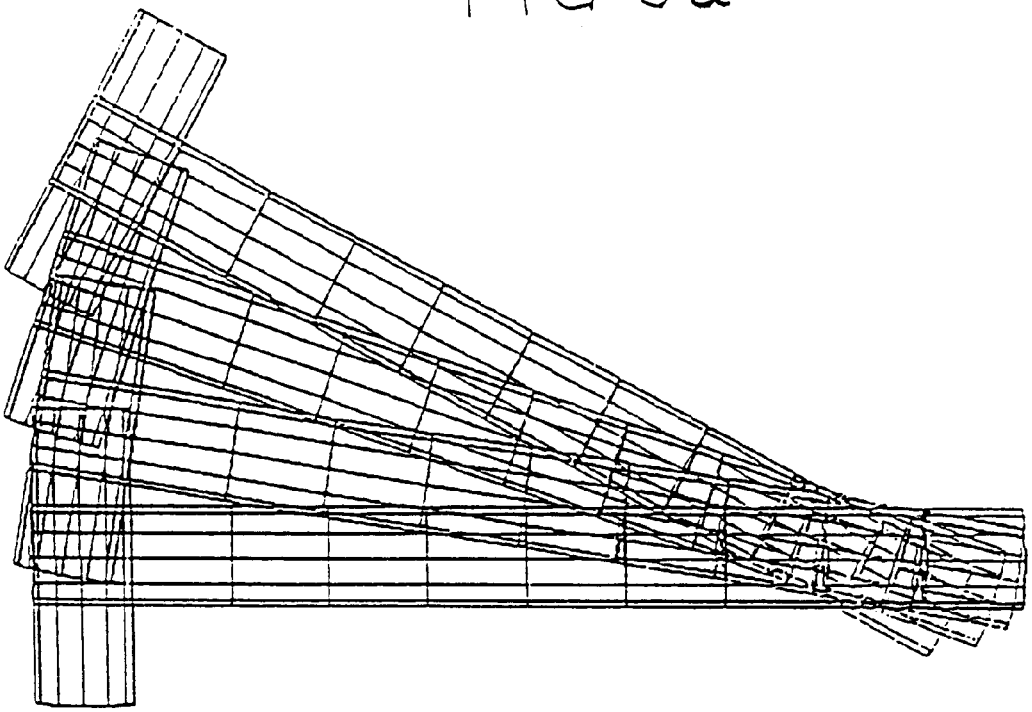
FIGS. 5*a* and 5*b* show schematically the rebound rotation without and with recoil damping, respectively.
Figure 5B:
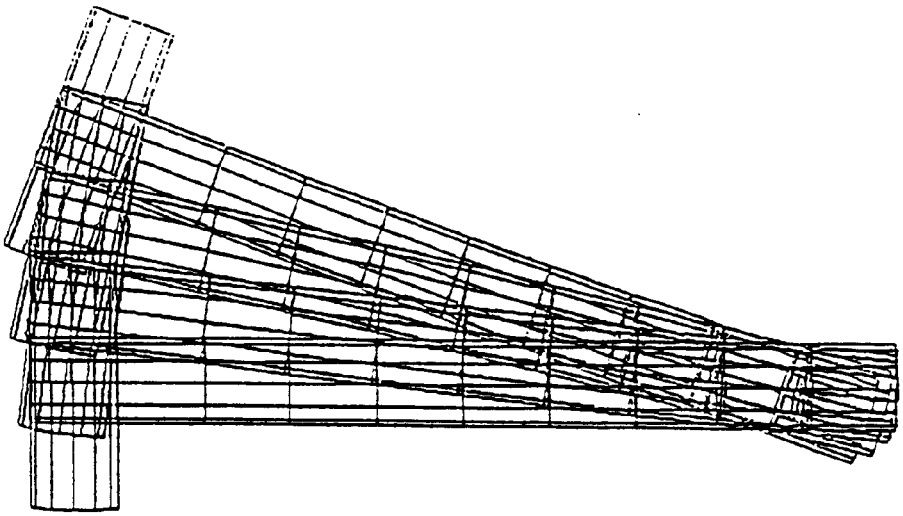

In connection with the stroke, an impact wave is generated which propagates backwardly in the hammer head with a velocity exceeding 5000 m/s. By disturbing this impact wave, a part of the impact wave energy can be converted into heat. The force between the hammer head and the underlying object will then be reduced. As described above in connection with FIGS. 1–3, this conversion is achieved by means of the particulate material contained in the internal cavity 20. FIG. 5*a* illustrates the recoil movement without damping, whereas FIG. 5*b* illustrates the recoil movement with damping. In both cases (FIGS. 5*a* and 5*b*), the hammer is provided with a counterweight.

Figure 4A:
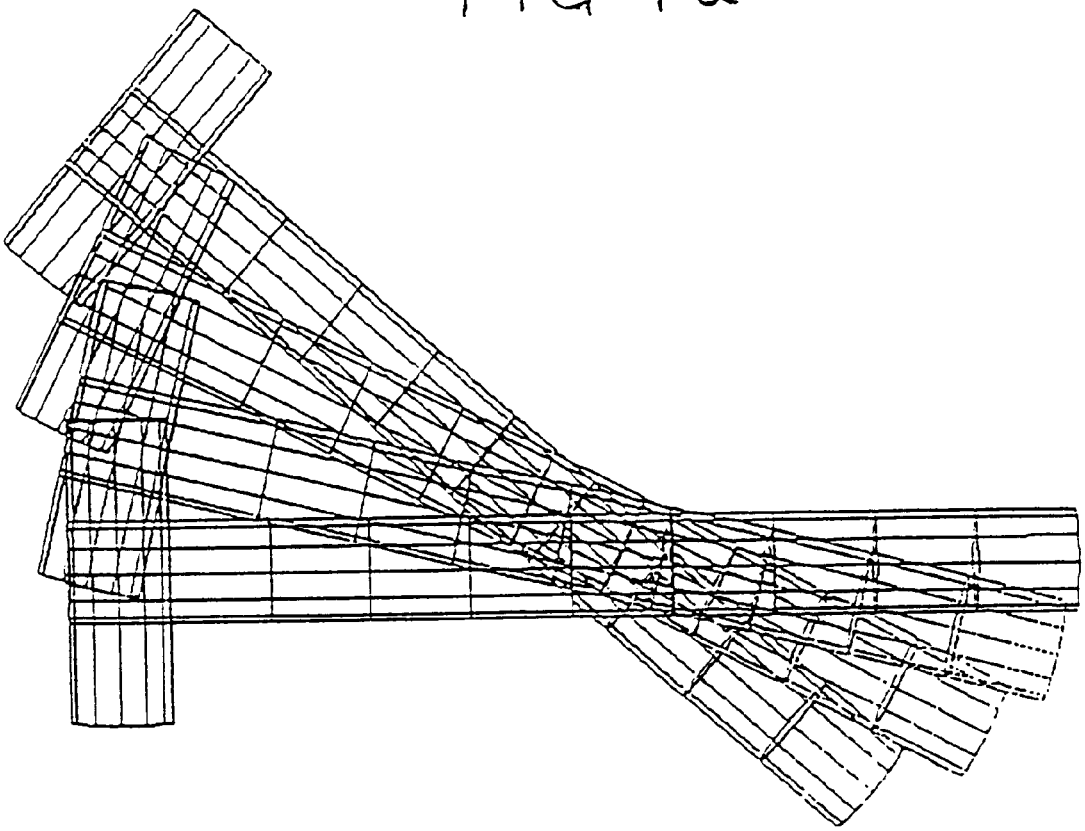
FIGS. 4*a* and 4*b* schematically illustrate the rebound rotation without and with a counterweight, respectively.
Figure 4B:
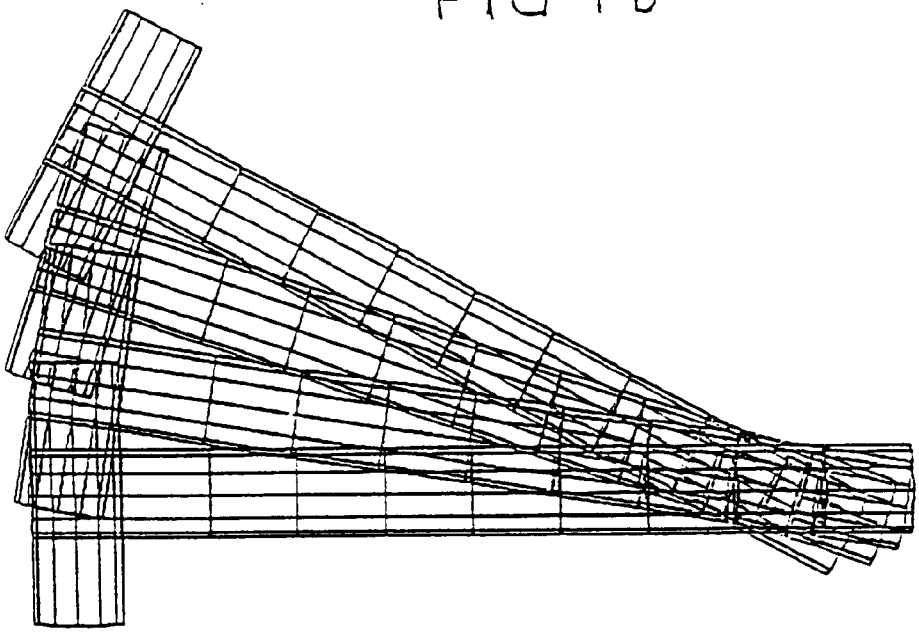

Since the above-mentioned force is not applied at a point coinciding with the centre of gravity of the hammer, a moment of force will be applied, which is constituted by the force multiplied by the distance between the force impact point on the hammer head and the centre of gravity. This moment of force generates a rebound rotation of the hammer, as illustrated in FIGS. 4*a*, 5*a*, 5*b*. The hammer, illustrated in FIG. 4*a* is of conventional design, without recoil damping and without any counterweight. For ergonomic reasons, it is advantageous if the recoil movement, including the rebound rotation coincides with the natural movement of the hand when the hammer is raised for a new stroke. If the rotation of the hammer is faster than the natural rotation of the hand during this movement, the handle of the hammer will strike against the finger side of the hand. The rotation of the hammer can be controlled by providing the hammer with a properly dimensioned counterweight 28 at the free end of the handle (FIGS. 1 and 2). This counterweight will displace the centre of gravity of the hammer away from the hammer head, whereby the moment of force striving to rotate the hammer is increased, but this is compensated by the fact that the counterweight increases the moment of inertia of the hammer. FIGS. 4*b*, 5*a* and 5*b* illustrate the rebound rotation of a hammer provided with a properly selected counterweight. Depending on the length and rigidity of the handle, the weight: of the counterweight is 10–70%, normally 20–40%, of the weight of the hammer head. It should be noted that the weight of the hammer head includes the weight of the lower impact element and the upper peen, ball or plastic tip as well as the weight of the particulate material in the cavity of the head.

After the stroke, apart from the translatory and rotary motions of the hammer, the hammer will start to vibrate. These vibrations are composed of the fundamental tone of the system and a number of harmonics. In general, the fundamental tone dominates, but it may happen that an overtone becomes dominant in case the hammer head hits obliquely. The amplitude may be so high that the vibrations of the handle give rise to an uncomfortable feeling in the hand. The rigidity of the handle and the size of the counterweight 28 located at the free end of the handle 14, see FIGS. 1–2, will affect the frequency of the fundamental tone as well as the movement of the handle 14. By properly selecting the rigidity and the size of the counterweight, the vibrations will be substantially reduced for the dominant fundamental tone at the middle of the hand gripping surface. This means that the vibration being transferred to the hand is minimized. The dampening time for the generated vibration may also be influenced as desired, i.e. shortened, by a proper choice of the dampening material contained in the handle of the hammer.

Figure 6A:
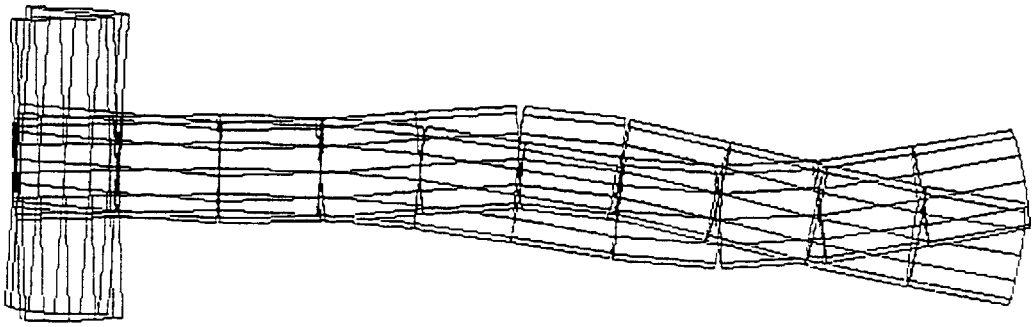
FIGS. 6*a*–6*c* show schematically how the vibrations in the handle are influenced by a counterweight.

FIG. 6*a* illustrates the vibrations of the handle after a stroke in case the hammer is not provided with any counterweight at the free end of the handle. It will be readily apparent from FIG. 6*a* that the free end of the handle oscillates with a large amplitude, which will of course be inconvenient to the person holding the handle of the hammer.

Figure 6B:
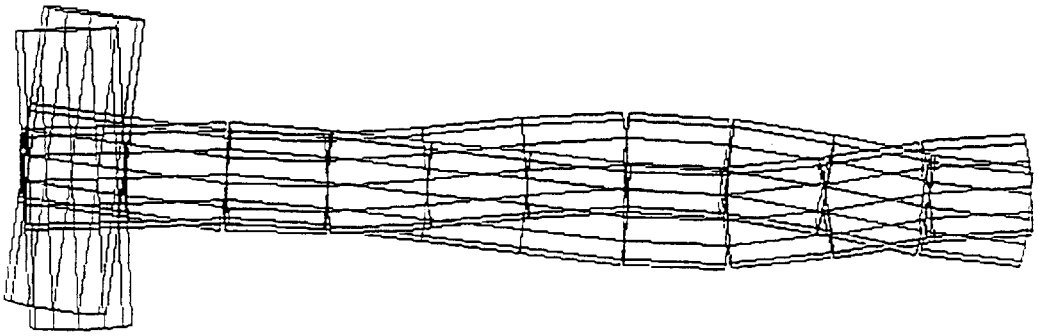

FIG. 6*b* illustrates schematically the vibrations in a hammer handle upon a stroke of a hammer being provided with a counterweight corresponding to 25% of the weight of the hammer head. It is clear that the oscillatory amplitude at the free end of the handle has been reduced considerably.

Figure 6C:
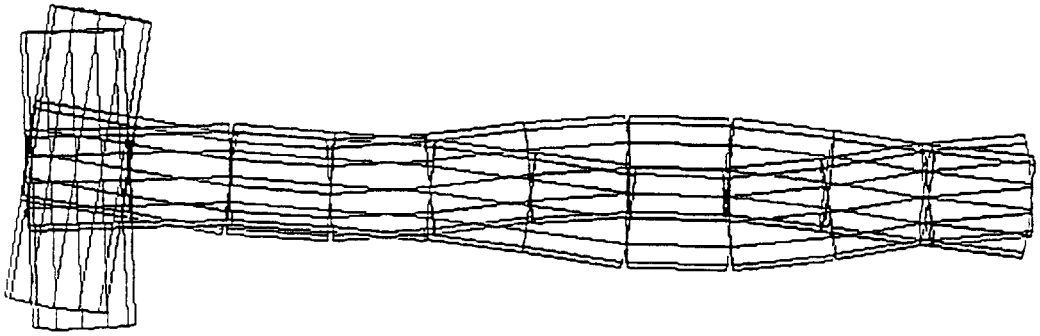

FIG. 6*c* illustrates schematically the vibrations of a hammer handle upon a stroke of a hammer being provided with a counterweight corresponding to 50% of the weight of the hammer head. It will be noted that the oscillatory amplitude has been reduced further in relation to the case of FIG. 6*b*.

To summarize, it may be concluded on the basis of the above, that the combination of a cavity in the head, said cavity being filled with a particulate material, and a counterweight at the free end of the handle, will result in a hammer having an excellent performance with regard to contact duration recoil movement and associated vibrations. Since the internal tube 13 is designed as a rigid element, a dynamic cooperation will occur between the head 12 and the counterweight 28, i.e. the handle will follow the movement during the stroke. Thus, the handle 14 need not be gripped as hard as with a conventional hammer, and a better control of the hammer stroke will be obtained. Of course, the degree of reduction of these parameters may be influenced, i.g. by the selection of the particulate material, the degree of filling the cavity and the weight of the counterweight in relation to e.g. the weight of the hammer head. The values stated in this specification concerning the relevant parameters should not be regarded to limit the scope of the claims but to constitute preferred embodiments.

Figure 7:
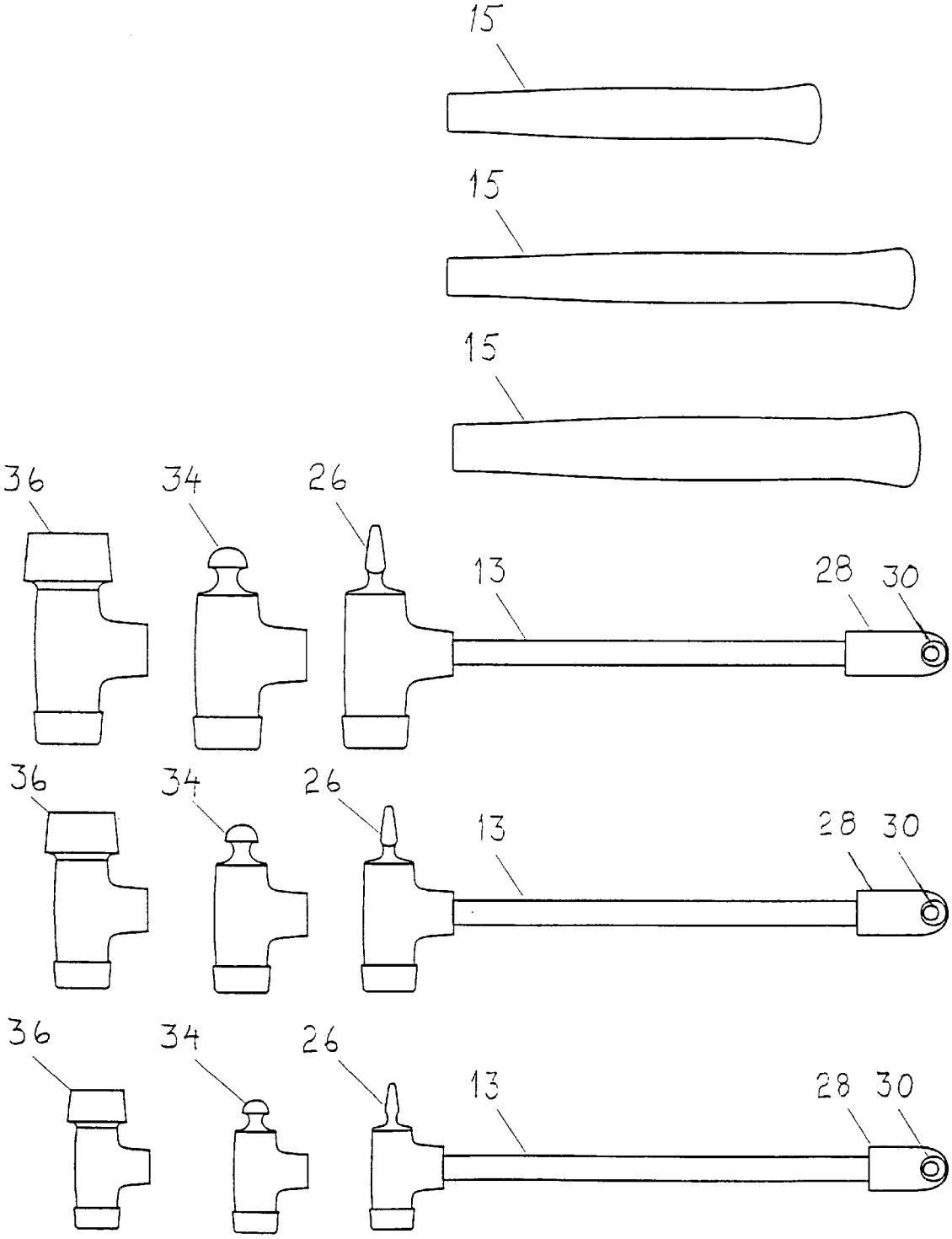
FIG. 7 shows exploded views of different modifications of various parts of a hammer according to the present invention.

FIG. 7 illustrates a possible design system according to the present invention, i.e. a basic structure of a hammer 10 comprises a head 12 and a tube 13 which is securely connected to the head 12. As appears from FIG. 7, the head 12 may be provided with an upper peen 26, a ball 34 or a (plastic) tip 36. These parts may be mounted on the hammer head 12 preferably by (laser) welding, press fit, soldering or threading. If the impact element 36 is made of plastic, a metallic intermediary element, on which the plastic impact element 36 is fastened, e.g. by threading, is preferably used.

The head 12 is provided with a lower impact element 24, which is preferably made (forged) in one piece with a head 12. However, it is also possible, that the impact element forms a separate part which is mounted in a suitable manner on the head.

The hammer head 12 may be made in different sizes, three sizes being shown as examples in FIG. 7.

It is also apparent from FIG. 7 that the tube 13 may be provided with an outer encasement 15 of different length or outer diameter. Of course, the length of the tube 13 must be conformed to the outer encasement 15, implying different lengths of the handle 14. By providing such alternative lengths and outer diameters of the handle, it is possible to make the necessary adjustments to various applications of use and to individual users.

The counterweight 28 is preferably mounted by a press fit onto the internal tube 13 of the handle 14. As indicated above, the weight of the counterweight 28 may be adjusted to the weight of the head 12 in order to obtain the desired functional features of the hammer 10 according to the present invention.

It is also conceivable, within the scope of the invention, to provide the handle with a specific weight distribution already at the time of manufacturing so that the counterweight is built into the handle of the hammer.

Thus, a basic feature of the invention is that the mass of the hammer is distributed so as to be substantially concentrated to the head 12 and the free end of the handle 14, whereas the handle 14 has a relatively small mass in the region of its grip portion 15.

The invention is not in any way limited to the described embodiments but can be freely varied within the scope of the depended claims.

We claim:

1. A hammer comprising:

a head having at least one impact surface, said head further including a cavity disposed therein, said cavity being partly filled with a particulate material to dampen recoil of the hammer;

a counterweight having a predetermined mass, said counterweight substantially displacing a center of gravity of the hammer away from said head while substantially increasing a moment of inertia of the hammer;

a handle having a grip portion, said handle further including an internal rigid hollow tube having a first end and a second end, said first end of said tube being in contact with and connected to said head, said second end being in contact with and connected to said counterweight, said counterweight being located at a free end of said handle, a mass distribution of the hammer is concentrated substantially at said hammer head and said counterweight, whereby upon a stroke of the hammer, recoil movement of the hammer will correspond to the natural movement of a user holding said grip portion of said handle, while vibrations of said handle at said gripping portion are substantially minimized.

2. A hammer (10) as defined in claim 1, wherein the weight of the counterweight (28) lies within the interval 10–70% of the weight of the head (12).

3. A hammer (10) as defined in claim 1, wherein the weight of the counterweight (28) lies within the interval 20–40% of the weight of the head (12).

4. A hammer (10) as defined in claim 1, wherein the counterweight (28) is mounted onto the tube (13) by means of a press fit.

5. A hammer (10) as defined in claim 1, wherein said grip portion of the handle (14) comprises an outer encasement (15) with a cambered shape approximately in the region of its longitudinal mid portion, said outer encasement (15) being made of a damping, elastic material.

6. A hammer (10) as defined in claim 1, wherein said tube (13) is connected to the hammer head (12) by means of a press fit.

7. A hammer (10) as defined in claim 1, wherein said cavity (21) is filled with the particulate material to at least 90%.

8. A hammer (10) as defined in claim 1, wherein said particulate material is constituted by steel pellets.

* * * * *